United States Patent [19]

Boyd

[11] 4,144,532

[45] Mar. 13, 1979

[54] THAW ALARM FOR FOOD FREEZER

[76] Inventor: Herman L. Boyd, P.O. Box 9, Savannah, Tenn. 38372

[21] Appl. No.: 823,207

[22] Filed: Aug. 9, 1977

Related U.S. Application Data

[63] Continuation-in-part of Ser. No. 685,170, May 11, 1976, abandoned.

[51] Int. Cl.[2] ..... G08B 21/00

[52] U.S. Cl. ..... 340/585; 200/61.83; 248/311.1 A

[58] Field of Search ..... 340/227.1, 585; 116/106; 200/61.83; 248/74 A, 316 D, 311.1 A

[56] References Cited

U.S. PATENT DOCUMENTS

| | | | |
|---|---|---|---|
| 2,601,142 | 6/1952 | Hubbard | 200/61.83 |
| 2,809,368 | 10/1957 | Ehlers, Jr. | 340/227.1 |
| 2,923,786 | 2/1960 | Jones | 340/227.1 |
| 3,182,337 | 5/1965 | Price | 248/311.1 A |
| 3,423,059 | 1/1969 | Kahn | 248/316 D |
| 3,896,278 | 7/1975 | Murawski | 200/61.83 |

*Primary Examiner*—Glen R. Swann, III

*Attorney, Agent, or Firm*—Clarence A. O'Brien; Harvey B. Jacobson

[57] ABSTRACT

A device having a single elongated non-metallic sealed container provided with electrical contacts is connected by appropriate electrical wiring to an alarm device. The electrical contacts are in a circuit with a displaceable electrically conductive member which may bridge the contacts for completing the circuit to the alarm device. A re-useable congealable material is contained within the sealed container, the congealable material having a predetermined low congealation temperature for maintaining the electrically-conductive member above the contacts as long as the device is at the suitable low temperature. On subjection of the sealed container to a sufficiently high temperature for a sufficient period of time, the congealable material takes on a liquid state and the electrically-conductive member is allowed to fall toward and bridge the contacts, thereby permitting electrical closure of the contacts when an undesirable temperature condition is present within the freezer compartment.

6 Claims, 10 Drawing Figures

32
40
44
14
30
18
16
20
28
46
26
24
42
44
34

74
66
76
78
80
82
60
54
56
68
64
62
58
78
84
50
76
50
52
22

60
64
54
56
68
62
58
50
50
52
22

78
84
80
78

74
66
76
70
72
76

54
68
50
52
22

44
36
40
18
14
22
28
26
44
42
38

THAW ALARM FOR FOOD FREEZER

CROSS-REFERENCE TO RELATED APPLICATION

The present application is a continuation-in-part of Ser. No. 685,170, filed May 11, 1976, now abandoned.

BACKGROUND OF THE INVENTION

1. Field of the Invention

The invention generally relates to means for providing a warning that the temperature in a food storage freezer is approaching a level whereat the frozen goods contained within the freezer are susceptible to thawing. In particular, the invention provides a switch and alarm system for signalling the operational failure of a freezer device.

2. Description of the Prior Art

Perishable foods and pharmaceuticals inter alia have long been frozen in order to prolong the useful life of such materials. In order to prevent spoilage of frozen consumable items and to maintain the quality of such items, it is important that these items remain frozen at all times after the initial freezing and until such time as the items are prepared for serving. Pharmaceuticals and similar substances which are typically maintained in hospitals and the like are often subject to rapid decomposition unless maintained in a low-temperature environment. Since freezing equipment is subject to unexpected failure, not only due to mechanical failure, but also due to unexpected power losses which can go undetected for relatively long periods of time under certain circumstances, frozen materials or materials maintained at a low temperature can thus be subject to spoilage if the freezer malfunction goes undetected. Devices previously provided for indicating a degradation of desired temperature conditions within a freezer have generally proved unsatisfactory when only a visual indication of the relatively high temperature conditions within the freezer was provided. In U.S. Pat. No. 3,896,278, issued to Murawski, et al., a gravity actuated plunger is retained in place by a freezable liquid, the plunger being maintained in spaced relation from an electrical contact until the freezable liquid is caused to melt by virtue of undesirably high temperatures within the freezer. Melting of the freezable liquid allows gravitationally induced movement of the plunger into electrically-conductive contact with the contact member, thereby initiating an audible alarm. The Murawski device, while providing a function similar to that of the present invention, is more complex in operation and, therefore, more subject to wear and consequent failure.

SUMMARY OF THE INVENTION

The present invention relates to a novel freezer monitor switch and alarm wherein a freezable fluid, preferably a liquid, sealed within a substantially cylindrical container acts to retain an electrically-conductive member in spaced relation to electrical contact elements when desired temperature conditions are present in a freezer compartment in which the present device is located. The present device is generally formed of a tubular member closed at the respective ends thereof, one end having a pair of electrical conductors extending therethrough into the interior of the tubular member, the conductors being sealed at the points of entry into the member. The conductors terminate interiorly of the tubular member in a pair of spaced electrical contacts.

A freezable liquid substantially filling the tubular member maintains an otherwise freely movable electrically-conductive member, preferably a spherical element, in spaced relation to the electrical contacts as long as the liquid is maintained in a frozen condition. The present device is disposed within the freezing compartment of a refrigerator or like appliance with the end of the tubular member having the electrical contacts formed therein disposed downwardly, the spherical element being thereby maintained above the electrical contacts. Should freezer failure occur, the frozen material within the tubular member is caused to melt, thereby releasing the spherical element which falls downwardly within the tubular member to engage the electrical contacts and thereby to close the switch formed by the contacts, an electrical circuit containing an alarm being thereby completed to provide a warning of the undesired temperature conditions present within the freezer compartment.

It is, therefore, an object of the present invention to provide a warning of undesirably high temperatures within a freezer compartment so that corrective action can be taken to prevent loss of the materials maintained within the freezer compartment.

It is another object of the invention to provide a novel freezer monitor switch and audible signal alarm which is reuseable, economical, easily installed and operated, and which does not consume appreciable amounts of energy.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
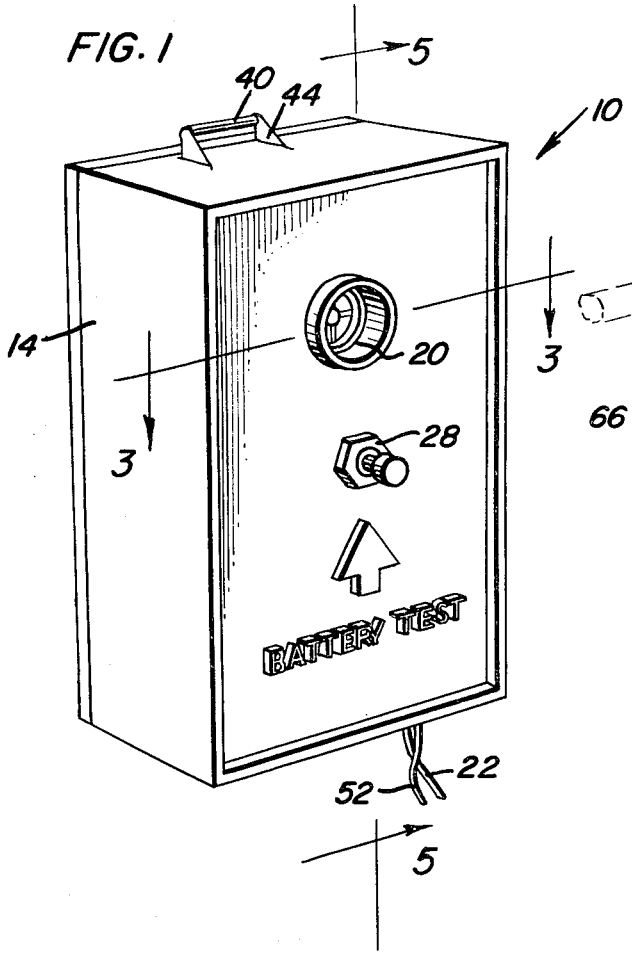
FIG. 1 is a perspective view of the alarm and power source test portion of the present invention.
Figure 2:
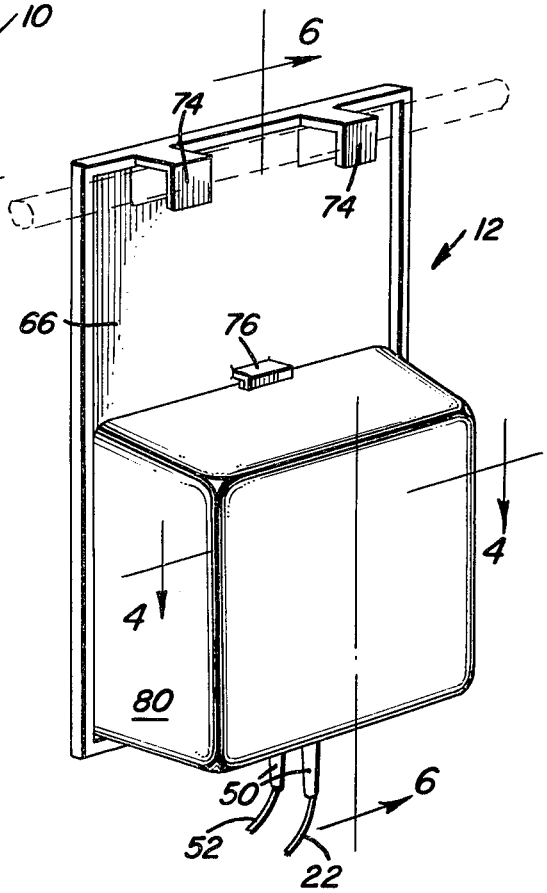
FIG. 2 is a perspective view of the portion of the invention which is maintained interiorly of a freezer compartment, the mounting structure of such portion being shown for purposes of illustration.
Figure 5:
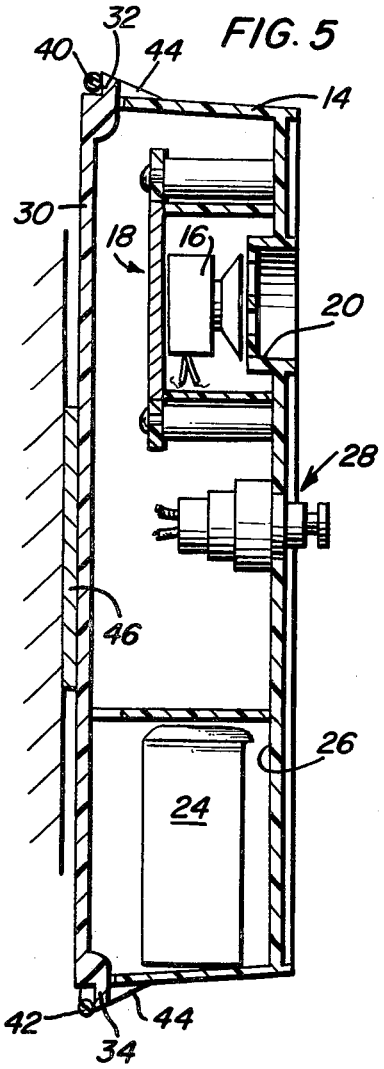
FIG. 5 is a sectional view taken along line 5—5 of FIG. 1.
Figure 10:
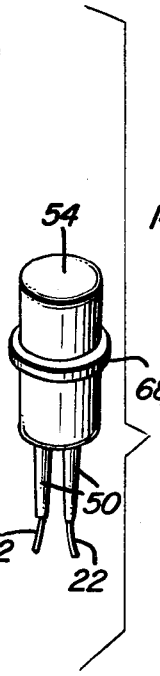
Figure 10:
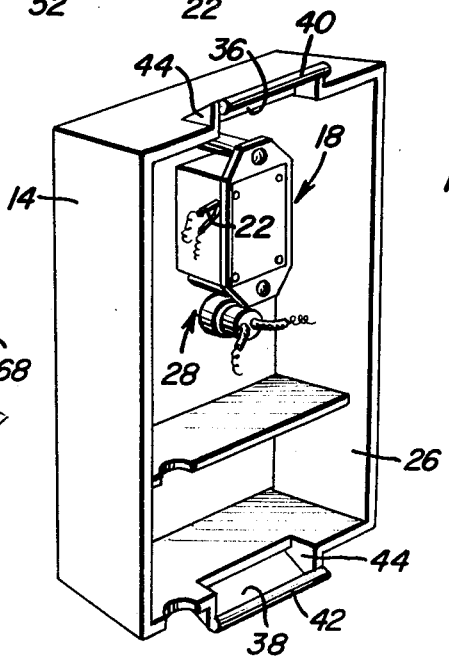

Referring now to FIGS. 1 and 2 of the drawings, an external alarm portion of the invention is seen at 10 in FIG. 1 and an internal thermally responsive portion of the invention is shown at 12 in FIG. 2. The alarm portion 10 is seen to be comprised of a housing 14 which substantially takes a rectangular form, the interior of the housing 14 being shown in detail in FIGS. 5 and 10. As seen in FIGS. 1, 5, and 10, an audible signal alarm 16 is mounted by mounting structure 18 at one end of the housing 14, a speaker aperture 20 being provided in the forward face of the housing 14. The alarm 16 can take the form of a buzzer or other device of known type, the alarm 16 being connected by conductive wires 22 to a source of electrical power, such as a battery 24, the battery being disposed within a lower compartment 26 formed in the other end of the housing 14. A battery test switch 28 of the spring-loaded push type is centrally mounted on the housing 14 and is connected in a series circuit with the alarm 16 and battery 24 in order that the alarm and battery may be tested to insure proper functioning thereof. The alarm 16 and battery 24 are further connected in a separate parallel circuit to the thermally responsive portion 12 of the device, which portion 12 is located remotely from the external alarm portion 10, the portion 12 being disposed within the freezer compartment of a refrigerator or the like which will be described in detail hereinafter.

Figure 3:
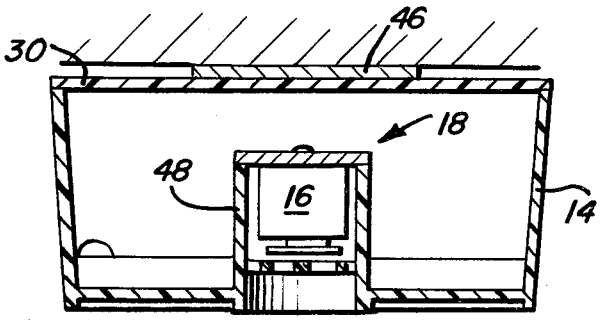
FIG. 3 is a sectional view taken along line 3—3 of FIG. 1.

The housing 14 is further provided with a back plate 30, the plate 30 having upper and lower extensions 32 and 34 which snap fit within apertures 36 and 38 formed in the upper and lower portions respectively of the housing 14, the apertures conveniently being defined by transverse bars 40 and 42 spaced from the upper and lower surfaces respectively of the housing 14 by means of raised extensions 44. The back plate 30 has a magnetic plate 46 attached to the external face thereof for mounting to the side of a refrigerator or similar apparatus. An adhesive element or other mounting material could be utilized in place of the magnetic plate 46 in a known fashion. FIG. 3 further illustrates the placement of the magnetic plate 46 on the back plate 30 of the housing 14, side elements 48 of the mounting structure 18 being further shown to enclose the signal alarm 16.

Figure 4:
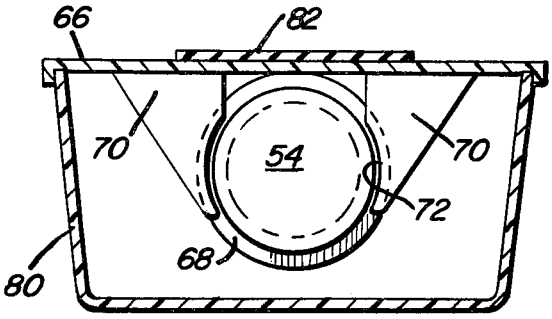
FIG. 4 is a sectional view taken along line 4—4 of FIG. 2.

One of the wires 22 from the signal alarm 16 extends outwardly of the housing 14 and into contact with an electrical lead 50 which extends into the interior of the thermally responsive portion 12 of the apparatus. A second electrical lead 50 is connected by an electrically-conductive wire 52 to the battery 24, the circuit thus formed being completed only by the disposition of an electrically-conductive element between the two electrical leads 50 as will be described hereinafter. The thermally responsive portion 12 of the invention has as its active subsystem a tubular member 54 which is sealed at both ends and contains a freezable or congealable liquid therewithin, the liquid being indicated by the numeral 56. As seen most clearly in FIGS. 6 and 7, one end 58 of the tubular member 54 has inner conductive ends 62 of the electrically-conductive leads 50 extending therethrough and being hermetically sealed within the end 58. A conductive member 64, which preferably takes the form of a sphere, is freely disposed within the interior of the tubular member 54 and, when the liquid 56 is not solidified due to freezing thereof, is freely movable within the tubular member 54. As shown in FIG. 7, the liquid 56 is frozen with the conductive member 64 maintained at the end 60 in spaced relation to the electrically-conductive ends 62 of the leads 50. In order to cause the conductive member 64 to be disposed within the end 60, the tubular member 54 is maintained under thermal conditions sufficient to freeze the liquid 56, the end 60 of the member 54 being disposed downwardly during the freezing process so that the conductive member 64 is maintained at the end 60. After the conductive member 64 has been so frozen at the end 60 of the tubular member 54, the tubular member 54 is then inverted into the position shown in FIG. 7. The conductive member 64 is thereby maintained in spaced relation to the electrically-conductive ends 62 of the leads 50, the member 64 being located at a point above ends 62. The tubular member 54 is then mounted on a mounting plate 66 by the placement of an annular flange 68 formed medially of the length of the tubular member 54 and on the external surface thereof within spaced receiving tabs 70 formed on the forward face of the mounting plate 66. As can also be seen in FIG. 4, the tabs 70 are provided with arcuate surfaces 72 formed on the inner ends thereof, the arcuate surfaces 72 essentially defining segments of a circle of a diameter slightly greater than the diameter of the tubular member 54 such that the tubular member 54 can be received by the tabs 70 and substantially held contiguously to the arcuate surfaces 72. Two of the tabs 70 are disposed on each side of the tubular member 54 and spaced apart a distance sufficient to receive the annular flange 68 therebetween. The mounting plate 66 is further provided with mounting brackets 74 at the upper end thereof to allow the thermally responsive portion 12 to be suspended from a rod or similar element of structure within a freezing compartment. Brackets 76 receive tabs 78 formed on upper and lower faces of an insulative cover 80 to mount said cover 80 to the face of the mounting plate 66 and in surmounting relation to the tubular member 54. The tubular member 54 and the frozen liquid 56 contained therein is thereby insulated by the cover 80 from inadvertent thawing due to opening of the freezer compartment or due to frost-removing drafts internally of the freezing unit.

An adhesive pad 82 is disposed on the rear face of the mounting plate 66 to allow mounting of the thermally responsive portion 12 of the present device within a freezing compartment as an alternative to the use of the brackets 74.

Figure 6:
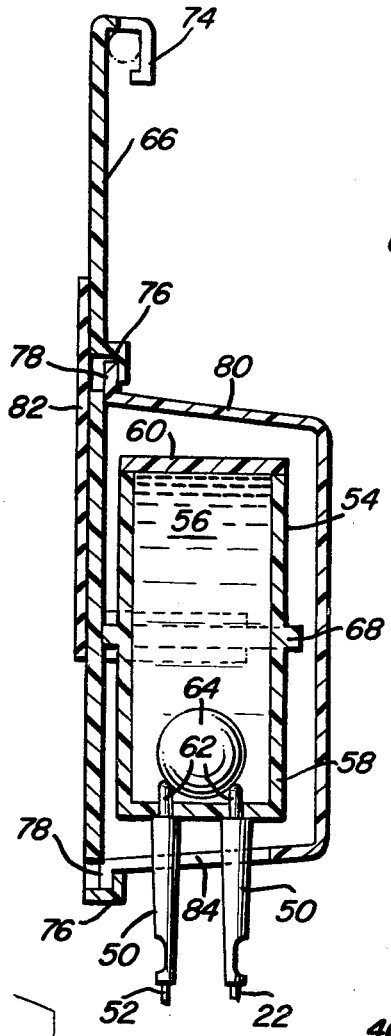
FIG. 6 is a sectional view taken along line 6—6 of FIG. 2.
Figure 7:
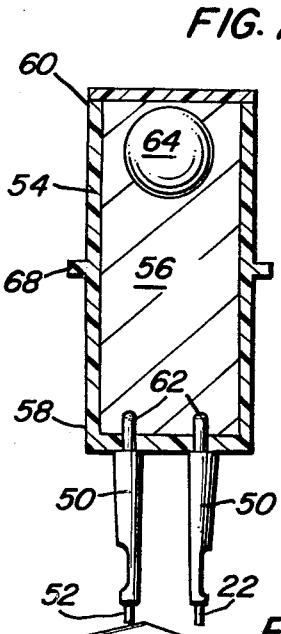
FIG. 7 is a detail elevational view in section of the tubular member containing the freezable liquid, electrical contacts, and movable electrically-conductive member of the invention, the tubular member being shown with the liquid in a frozen condition maintaining the conductive member in spaced relation to the electrical contacts.
Figure 9:
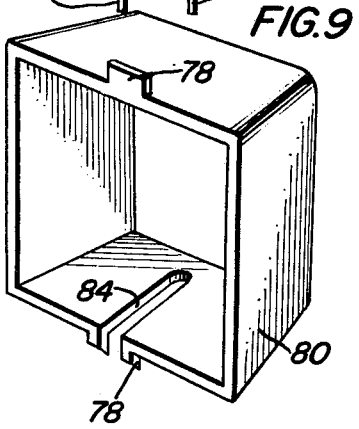
FIG. 9 is a perspective view of an insulative cover which is mountable on the mounting structure of FIG. 8 to provide protection for and insulation of the tubular member; and, FIG. 10 is a perspective view of the alarm portion of the device, the interior thereof being shown for purposes of illustration.
Figure 8:
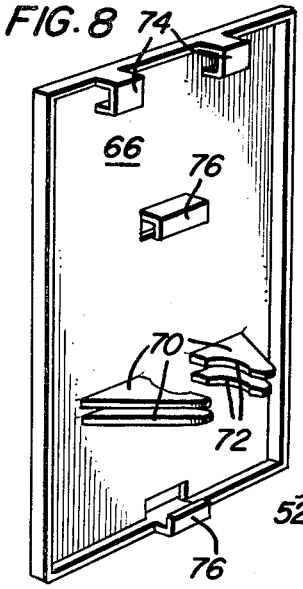
FIG. 8 is a perspective assembly view of the mounting apparatus of the invention.

Referring now to FIG. 6, the thermally responsive portion 12 of the present device is seen to have been subjected to temperatures above the melting point of the liquid 56. The liquid 56 on melting releases the conductive member 64 to allow the member 64 to be displaced downwardly under the influence of gravity, the ends 62 of the conductive leads 50 being thereby engaged by the conductive member 64 to complete the circuit of which the wires 22 and 52 form a portion. Completion of this electrical circuit in which the battery 24 and signal alarm 16 are provided causes the signal alarm 16 to be activated, thereby providing a warning that the temperature within the freezing compartment has reached a level whereat frozen materials maintained therein will begin to thaw and spoil.

The liquid 56 utilized within the tubular member 54 can be selected in order to have a freezing (and melting) point at a desired temperature. Since water freezes at 32 degrees F. and foods begin to thaw at between 0 and 15 degrees F., water may be used in combination with alcohol or other substances which reduce the freezing point of the water to a desired level. It is further important to assure that the liquid 56 is maintained within the tubular member 54 in a sealed condition, since sublimation of a frozen material can occur over a period of time, thereby depleting the frozen material and rendering the device useless.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. Apparatus for providing a sensorially perceptible indication of the attainment of an undesirable thermal condition within a freezer, comprising:

alarm means for signalling the existence of a predetermined temperature within the freezer, the alarm means being disposed externally of the freezer;

thermally responsive means for responding physically to a change in temperature within the freezer comprising a sealed tubular member having a congealable material disposed therewithin, and an electrically conductive member formed into a sphere freely displaceable within the tubular member when the congealable material is in the liquid state;

circuit means electrically connecting the alarm means and the thermally responsive means for completing an electrical circuit therebetween on attainment of an undesirable thermal condition within the freezer;

electrically conductive leads disposed in one end of the tubular member, electrically conductive ends of the lead members extending into the interior of said tubular member and being spaced apart, contact between the electrically conductive member and the ends of the leads completing the circuit means to activate the alarm means;

a mounting plate; and, tab members formed on the mounting plate, the tab members forming vertically spaced concentric arcuate surfaces with each said surface defining a portion of a circle of a diameter slightly greater than the diameter of the tubular member to allow receipt of the tubular member within each said arcuate surface, the tubular member having an annular flange receivable between the vertically spaced arcuate surfaces to removably mount the tubular member on the mounting plate.

2. The apparatus of claim 1 and further comprising:

an insulative cover mountable to the mounting plate in surmounting and covering relation to the tubular member.

3. The apparatus of claim 2 wherein the alarm means comprise:

a housing having a speaker aperture formed in one face thereof;

an audible signal alarm disposed and mounted within the housing, the alarm being disposed in opposing relation to the aperature; and, a battery disposed within the housing and electrically connected to the signal alarm.

4. The apparatus of claim 3 wherein the circuit means comprise electrically conductive wires connecting the signal alarm, battery, and the electrically conductive leads disposed in the tubular member, engagement of the conductive member with the leads completing the circuit formed thereby.

5. The apparatus of claim 4 wherein the circuit means further comprises a battery test device disposed in a circuit formed by the circuit means and electrically conductive wires connecting the signal alarm and battery in series with said battery test device, the said battery test device being connected parallel to the thermally responsive means.

6. A device for signaling the existence of a predetermined thermal condition existing in an environment, comprising:

electrically actuated alarm means for providing a signal indicative of the attainment of the said predetermined thermal condition;

thermally responsive switch means which are actuated upon the attainment of the said predetermined thermal condition;

circuit means for electrically connecting the said switch means and the said alarm means for providing current through said switch means to the said alarm means upon the attainment of said predetermined thermal condition;

mounting means for mounting the said thermally responsive switch means in the said environment comprising:

a sealed tubular member encasing said switch means;

an annular flange connected to said sealed tubular member;

a mounting plate; and, vertically spaced tab members formed on the mounting plate for receiving said annular flange therebetween, said vertically spaced tab members being conformed to engage a portion of the periphery of said sealed tubular member to provide lateral support for said sealed tubular member while said annular flange provides vertical support for said sealed tubular member.

* * * * *